US012679609B2

(12) United States Patent
Jacob et al.

(10) Patent No.: US 12,679,609 B2
(45) Date of Patent: Jul. 14, 2026

(54) VERTICAL-FEED PERSONAL HYDRATION SYSTEM

(71) Applicant: Brumate, Inc., Denver, CO (US)

(72) Inventors: Dylan M. Jacob, Denver, CO (US); Jordan Westerberg, Denver, CO (US)

(73) Assignee: BRUMATE, LLC, Denver, CO (US)

( * ) Notice: Subject to any disclaimer, the term of this patent is extended or adjusted under 35 U.S.C. 154(b) by 197 days.

(21) Appl. No.: 18/585,940

(22) Filed: Feb. 23, 2024

(65) Prior Publication Data

US 2025/0270008 A1 Aug. 28, 2025

(51) Int. Cl.

| | |
|---|---|
| ***B65D 47/20*** | (2006.01) |
| ***A45F 3/18*** | (2006.01) |
| ***B65D 47/32*** | (2006.01) |
| ***B65D 81/38*** | (2006.01) |

(52) U.S. Cl.
CPC ..... *B65D 47/2031* (2013.01); *A45F 3/18* (2013.01); *B65D 47/32* (2013.01); *B65D 81/3869* (2013.01)

(58) Field of Classification Search
CPC . A47G 19/2272; B65D 47/32; B65D 47/2031
USPC ..... 220/705, 709, 714
See application file for complete search history.

(56) References Cited

U.S. PATENT DOCUMENTS

| | | | | |
|---|---|---|---|---|
| 4,854,343 | A | 8/1989 | Rilett | |
| 5,894,955 | A | 4/1999 | Garrigues | |
| 6,145,695 | A * | 11/2000 | Garrigues | B62J 11/16 222/61 |
| 10,246,228 | B2 | 4/2019 | Meyers et al. | |
| D853,658 | S | 7/2019 | Bowles et al. | |
| 10,357,073 | B1 | 7/2019 | Stahl et al. | |
| D870,998 | S | 12/2019 | Bowles et al. | |
| D870,999 | S | 12/2019 | Bowles et al. | |
| D871,698 | S | 12/2019 | Bowles et al. | |
| D871,699 | S | 12/2019 | Jaeger et al. | |

(Continued)

OTHER PUBLICATIONS

FluidLogic, "FluidLogic WAVE™: The New WAVE of Hydration! 60sec", Available online at: <https://www.youtube.com/watch?v=DyZUJCXphvY>, Jun. 13, 2022, 1 page.

(Continued)

*Primary Examiner* — Jeffrey R Allen
(74) *Attorney, Agent, or Firm* — Shook, Hardy & Bacon L.L.P.

(57) ABSTRACT

Systems and methods for a vertical-feed personal hydration system are provided. In some embodiments, a personal hydration system is provided that facilitates drainage of fluid from a fluid delivery tube back into the fluid reservoir when a user has completed taking a drink from a mouthpiece. The personal hydration system may comprise a venting cap assembly comprising a straw that that extends down into a reservoir of a hydration vessel, and a fluid delivery tube that extends between the venting cap assembly and a valve operated mouthpiece. The venting cap assembly may include a quick release hose connector used to quickly separate and re-attach the fluid delivery tube from the hydration vessel. The hydration vessel may comprise a stainless steel alloy material, and/or fabricated using other alloys or materials such as a titanium alloy, a ceramic material, or other composite materials. The hydration vessel may comprise an insulated vessel.

20 Claims, 8 Drawing Sheets

(56) References Cited

U.S. PATENT DOCUMENTS

| | | | | |
|---|---|---|---|---|
| 10,492,552 | B2 | 12/2019 | Jaeger et al. | |
| 10,502,351 | B2 | 12/2019 | Jaeger et al. | |
| 10,588,396 | B2 * | 3/2020 | Soley | A45F 3/20 |
| 11,137,098 | B2 | 10/2021 | Jaeger et al. | |
| 11,154,734 | B2 | 10/2021 | Jaeger et al. | |
| 11,470,904 | B2 | 10/2022 | Stahl et al. | |
| 11,717,709 | B2 | 8/2023 | Jaeger et al. | |
| 11,780,657 | B2 * | 10/2023 | Hamel | B65D 47/122 220/203.11 |
| 2005/0056652 | A1 | 3/2005 | Cezeaux | |
| 2006/0231561 | A1 | 10/2006 | Choi et al. | |
| 2006/0255169 | A1 | 11/2006 | Gieson | |
| 2018/0035787 | A1 | 2/2018 | Jaeger et al. | |
| 2018/0035788 | A1 | 2/2018 | Jaeger et al. | |
| 2018/0035789 | A1 | 2/2018 | Jaeger et al. | |
| 2018/0035790 | A1 | 2/2018 | Jaeger et al. | |
| 2018/0035791 | A1 | 2/2018 | Jaeger et al. | |
| 2018/0038374 | A1 | 2/2018 | Jaeger et al. | |
| 2018/0038534 | A1 | 2/2018 | Jaeger et al. | |
| 2018/0042366 | A1 | 2/2018 | Jaeger et al. | |
| 2018/0066779 | A1 | 3/2018 | Jaeger et al. | |
| 2018/0067504 | A1 | 3/2018 | Jaeger et al. | |
| 2018/0192724 | A1 | 7/2018 | Jaeger et al. | |
| 2018/0193676 | A1 | 7/2018 | Jaeger et al. | |
| 2018/0193677 | A1 | 7/2018 | Jaeger et al. | |
| 2018/0195654 | A1 | 7/2018 | Jaeger et al. | |
| 2019/0223534 | A1 | 7/2019 | Stahl et al. | |
| 2020/0352270 | A1 | 11/2020 | Stahl et al. | |
| 2022/0026000 | A1 | 1/2022 | Jaeger et al. | |
| 2023/0039396 | A1 | 2/2023 | Stahl et al. | |
| 2023/0381554 | A1 | 11/2023 | Jaeger et al. | |

OTHER PUBLICATIONS

Shellbacktactical, Source Tactical Storm—Push-pull Hydration Bladder Valve, Available online at: <https://www.shellbacktactical.com/source-tactical-storm-push-pull-hydration-bladder-valve/>, accessed Feb. 15, 2024, pp. 3.

Storm., "High Flow Drinking Valve—Shop Now | Source Outdoor", Online available at: <https://sourceoutdoor.com/product/storm/>, accessed Feb. 15, 2024, pp. 3.

* cited by examiner

VERTICAL-FEED PERSONAL HYDRATION SYSTEM

BACKGROUND

A personal hydration system, often referred to as a hydration pack, is a portable system designed to provide a person with a convenient way for a user to remain hydrated during outdoor activities such as hiking, biking, running, or camping, among other activities. A hydration system may include a bladder, or other form of reservoir, for holding a hydrating fluid (e.g., water), and a hose or tube connecting the reservoir to a mouthpiece used for drinking. The hydration system may be worn by the user, such as in a pouch or a backpack, with the mouthpiece routed over their shoulder, providing the user with a hands-free way to drink from the reservoir while on the move.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

One or more of the embodiments presented in this disclosure, among other thing, provide for a vertical-feed based personal hydration system that facilitates the drainage of fluid from a fluid delivery tube and back into the fluid reservoir when the user has completed taking a drink from a mouthpiece. The personal hydration system may comprise a venting cap assembly comprising a straw that that extends down into a reservoir of a hydration vessel, and a fluid delivery tube that extends between the venting cap assembly and a valve operated mouthpiece. The venting cap assembly may include a quick release hose connector used to quickly separate and re-attach the fluid delivery tube from the hydration vessel. The hydration vessel may comprise a stainless steel alloy material, and/or fabricated using other alloys or materials such as a titanium alloy, a ceramic material, or other composite materials. The hydration vessel may comprise an insulated vessel. The personal hydration system may function as a vertical-feed system in that hydrating fluids are drawn by the user from the reservoir by opening the valve operated mouthpiece, and applying a suction to a drinking port of the mouthpiece. When the user has completed taking a drink from the hydration system, they can cease applying suction to the mouthpiece and leave the mouthpiece open until fluid remaining in the fluid delivery tube drains back into the reservoir. As such, the non-dispensed fluid does not remain in the fluid delivery tube, where it may be subject to undesired heating and/or freezing due to environmental conditions, and/or absorbing undesired tastes from remaining in the fluid delivery tube.

BRIEF DESCRIPTION OF THE DRAWINGS

Aspects of the present disclosure are described in detail herein with reference to the attached Figures, which are intended to be exemplary and non-limiting, wherein.

DETAILED DESCRIPTION

Figure 1:
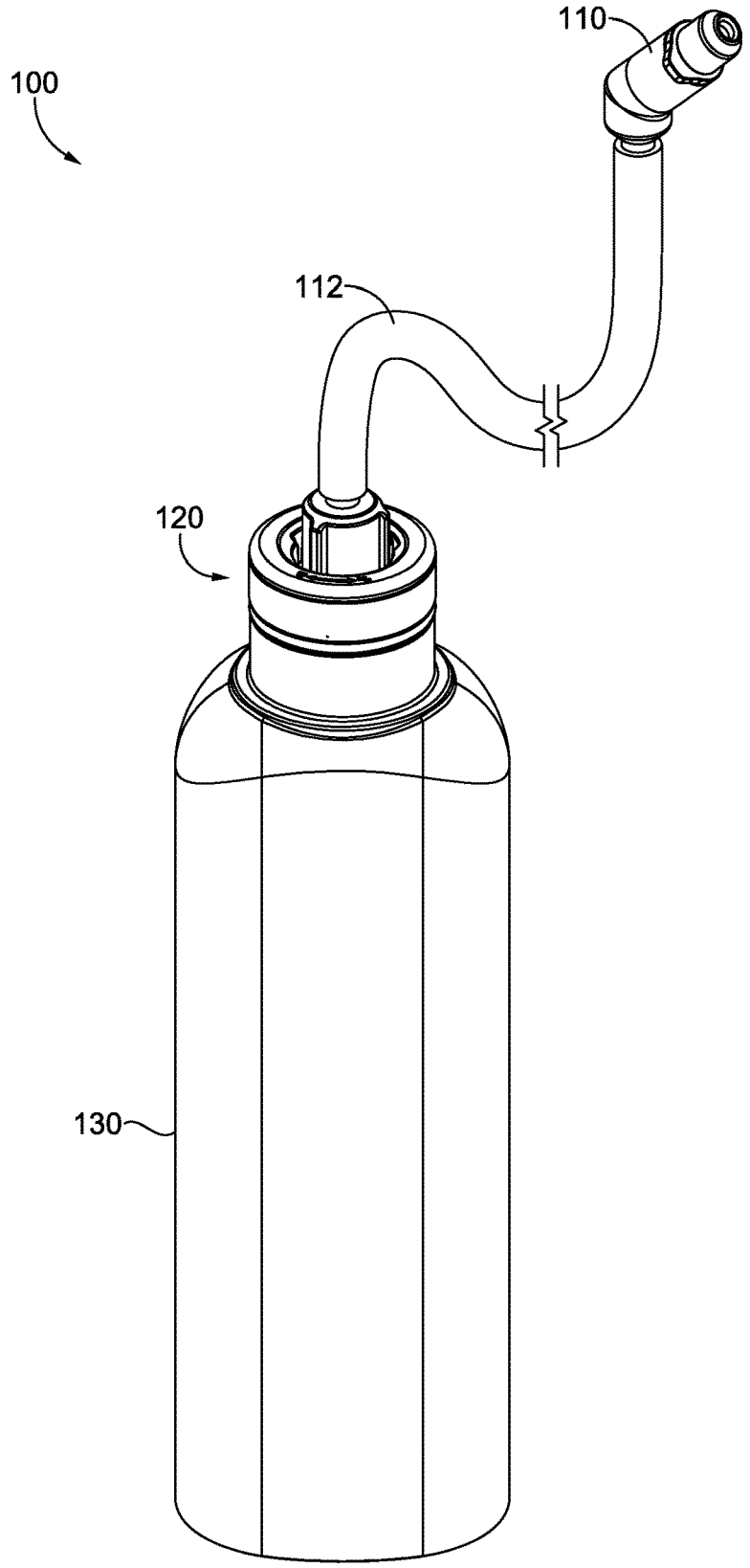
FIG. 1 is a diagram illustrating an example vertical-feed based personal hydration system, in accordance with an embodiment of the present disclosure.

In the following detailed description, reference is made to the accompanying drawings that form a part hereof, and in which is shown specific illustrative example embodiments in which the embodiments may be practiced. These embodiments are described in sufficient detail to enable those skilled in the art to practice the embodiments, and it is to be understood that other embodiments may be utilized, and that logical, mechanical, and electrical changes may be made without departing from the scope of the present disclosure. The following detailed description is, therefore, not to be taken in a limiting sense.

Personal hydration systems, particularly those worn in conjunction with backpacks and/or slings, are primarily gravity fed systems that rely on the force of gravity to deliver water from a reservoir (e.g., a bladder) to a drinking nozzle. For example, a hose may be attached to a bottom the reservoir, and water (or other fluid) flows down through the hose to the drinking nozzle for consumption by the user. The drinking nozzle may comprise a flow control valve in the form of a bite valve. The user may open the drinking nozzle to initiate flow through the hose and dispense water into the mouth of the user by biting down on the bite valve. A difference in elevation between the reservoir and the drinking nozzle (with the reservoir at a higher elevation relative to the drinking nozzle) permits gravity to provide the force for transporting the water through the hose.

However, several problems may occur when using gravity fed personal hydration systems with respect to stagnate fluids remaining in the hose between drinking sessions. For example, when the user finishes taking a drink from the drinking nozzle, they may release their bite on the bite valve to close the drinking nozzle and stop the flow of water. Closing of the drinking nozzle seals that end of the hose, essentially forming a backpressure in the hose that prevents the water from draining. Further, with a gravity fed system, while gravity provides the force that motivates the flow of water from the bottom of the reservoir, through the hose, and out from the drinking nozzle, there is no counter-force to motivate water to drain from the hose back into the reservoir when drinking is completed. As such, during warm environmental conditions (such as where the hydration system is being used in conjunction with activities such as hiking, biking, and/or warm weather camping) the water in the hose may become very warm such that when the user operates the drinking nozzle to quench their thirst, the drinking nozzle undesirably dispenses warm water directly into the user's mouth. Moreover, in such conditions where the water in the hose may be warmed due to warm ambient conditions, undesirable flavor characteristics my leach from the hose into the water-substantially degrading the experience of drinking from the hydration system. Conversely, in cold ambient conditions (such as where the hydration system is being used in conjunction with skiing, snowboarding, snowshoeing and/or cold weather camping) the water in the hose may freeze, limiting and/or blocking the flow of water to the drinking nozzle, and/or damaging components of the hydration system due to ice expanding within the system.

In contrast to such prior hydration systems, embodiments of the present disclosure, among other things, provide for a vertical-feed based personal hydration system that facilitates the drainage of fluid from a fluid delivery tube and back into the fluid reservoir when the user has completed taking a drink from a mouthpiece. More specifically, in some embodiments, a personal hydration system may comprise a venting cap assembly comprising a straw that that extends down into a reservoir of a hydration vessel, and a fluid delivery tube that extends between the venting cap assembly and a valve operated mouthpiece. The straw that extends into the hydration vessel may be detachable from the venting cap assembly. The hydration vessel may comprise a stainless steel alloy material, and/or fabricated using other alloys or materials such as a titanium alloy, a ceramic material, or other composite materials. The hydration vessel may comprise an insulated vessel. For example, the body of the hydration vessel may comprise a double-walled housing that includes an outer wall and an inner wall separated by an insulating medium. In some embodiments, the insulating medium comprises a vacuum formed between the outer wall and the inner wall. In some embodiments, the insulating medium 213 may comprise an insulating foam or other material having a low thermal conductivity (e.g., Styrofoam).

The personal hydration system may function as a vertical-feed system in that hydrating fluids (e.g., water) are drawn by the user from the reservoir by opening the valve operated mouthpiece, and applying a suction to a drinking port of the mouthpiece. With the suction applied, the fluid is drawn vertically up the straw of the venting cap assembly, through the venting cap assembly and fluid delivery tube, and dispensed from the drinking port. The venting cap assembly comprises an equalization valve that opens to permits outside air to enter the hydration vessel in response to the user drawing fluid from the hydration vessel—thereby avoiding a buildup of negative pressure inside the hydration vessel. Moreover, the venting cap assembly may include a quick release hose connector used to quickly separate and re-attach the fluid delivery tube from the hydration vessel.

The mouthpiece may comprise a position-latching flow control valve. That is, the user applies an actuation force to open the mouthpiece, and an actuation force to close the mouthpiece. The state of the mouthpiece flow control valve (e.g., an open state or a closed state) remains latched until a force is applied by the user to switch the mouthpiece to the other state. When the user has completed taking a drink from the hydration system, they can cease applying suction to the mouthpiece and leave the mouthpiece open until fluid remaining in the fluid delivery tube drains back into the reservoir. As such, the non-dispensed fluid does not remain in the fluid delivery tube, where it may be subject to undesired heating and/or freezing due to environmental conditions, and/or absorbing undesired tastes from remaining in the fluid delivery tube. In some embodiments, the fluid may be drawn back into the reservoir based on the force of gravity and/or a differential in pressure between atmospheric pressure at the open mouthpiece and the air within the reservoir. Once the fluid has drained from the fluid delivery tube, the user may close the valve of the mouthpiece.

Referring now to FIG. 1, FIG. 1 is a diagram illustrating a hydration system 100 according to embodiments of the present disclosure. As shown in FIG. 1, the hydration system 100 may include a valve operated mouthpiece 110 coupled to one end of a fluid delivery tube 112. The opposing end of the fluid delivery tube 112 may, in turn, be coupled to a hydration vessel 130 via a venting cap assembly 120. In some embodiments, the mouthpiece 110 may comprise a position-latching flow control valve, meaning that the flow control valve may switch between opened and closed states in response to the application of an actuation force. For example, when the user applies an actuation force to a closed mouthpiece 110, the flow control valve of the mouthpiece 110 opens and remains open until a subsequent force is applied to close the mouthpiece 110. When the user applies an actuation force to an open mouthpiece 110, the valve of the mouthpiece 110 closes and remains closed until a subsequent force is applied to open the mouthpiece 110. Examples of a position-latching valves for mouthpiece 110 may include, but are not limited to, a push-pull valve, a dial-controlled valve, a lever-controlled valve, and/or a button-activated valve. In contrast, a bite valve is an example of a non-position-latching valve because a closed bite valve opens in response to the pressure applied by the force of a user biting on the valve, and automatically re-closes in response to the removal of that pressure. The fluid delivery tube 112 may comprise any type of flexible and/or semi-flexible tubing material that can transport fluid from the hydration vessel 130 in response to a vacuum being drawn from the mouthpiece 110 (e.g., by a user drawing a vacuum using their mouth to drink from the hydration vessel 130).

The hydration vessel 130 may comprise a stainless steel alloy material (e.g., an 18/8, 18/10, 304, or 316, grade stainless steel), and/or fabricated using other alloys or materials such as a titanium alloy, a ceramic material, or other composite materials. Moreover, in some embodiments, hydration vessel 130 may comprise an insulated vessel. That is, the body of the hydration vessel 130 may comprise an first outer wall and a second inner wall, that are separated by a thermal insulator such as a vacuum and/or thermal insulating materials. The hydration vessel 130 may be coupled to the fluid delivery tube 112 by the venting cap assembly 120. As described greater with respect to FIG. 2, the venting cap assembly 120 may include a quick release hose connector that may be used to quickly detach and re-attach the fluid delivery tube 112 from the hydration vessel 130. Moreover, the venting cap assembly 120 comprises a cap assembly that includes an equalization valve (such as equalization valve 400 discussed below) that permits outside air to enter the hydration vessel 130 as the user draws fluid from the hydration vessel 130—thereby avoiding a buildup of negative pressure inside the hydration vessel 130 as the user drinks from the hydration vessel 130. That is, the venting cap assembly 120 may comprises an equalization valve configured to open in response to a suction applied to the mouthpiece 110, to pass an equalizing air into the reservoir 218 from an environment external to the hydration vessel 130. As a result, the amount of effort for the user to draw fluid from the hydration vessel 130 to the mouthpiece 110 will remain constant or nearly constant and not increase due to increasing back-pressure developing in the hydration vessel 130. After the user has finished drawing from the hydration vessel 130, they may release the mouthpiece 110 from their mouth. Because the mouthpiece 110 comprises a state-sustaining valve, it may remain in an open state such that the external air-pressure and/or gravity causes the fluid remaining in the fluid delivery tube 112 to drain back into the hydration vessel 130—thus avoiding a configuration where fluid within the fluid delivery tube 112 freezes or heats-up do to environmental conditions, or otherwise remains stagnant within the fluid delivery tube 112.

Figure 2:
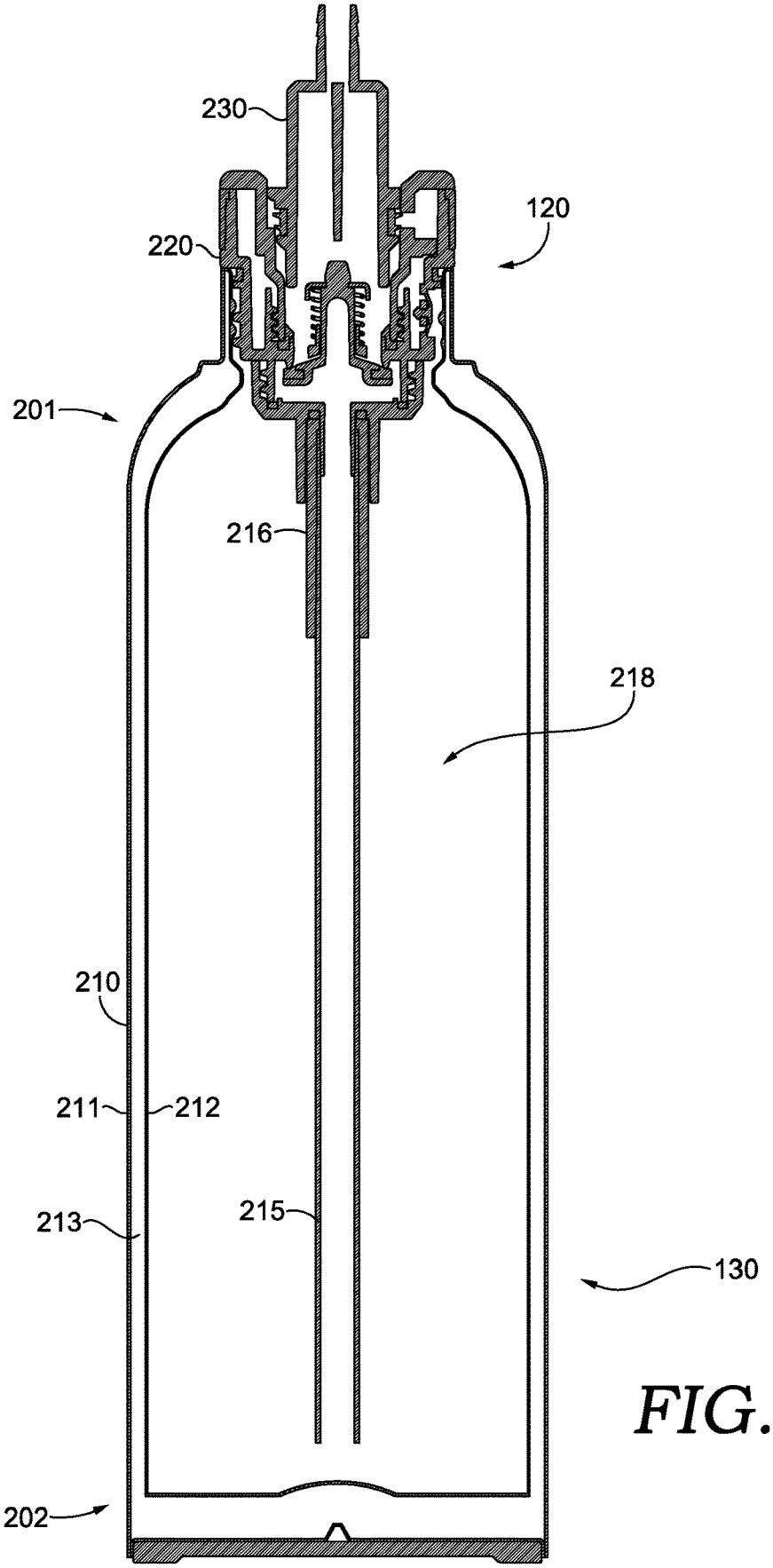
FIG. 2 is a cross sectional illustration an example of an hydration vessel and venting cap assembly, in accordance with an embodiment of the present disclosure.

Referring now to FIG. 2, FIG. 2 is a cross sectional illustration of the hydration vessel 130 and venting cap assembly 120. Starting with the hydration vessel 130, as shown in FIG. 2, the hydration vessel 130 comprises a housing 210 that includes an interior volume that defines a reservoir 218 for holding a hydrating fluid. The housing 210 may comprise an insulating housing. For example, the housing 210 may comprise a double-walled housing that includes an outer wall 211 and an inner wall 212 separated by an insulating medium 213. In some embodiments, the insulating medium 213 comprises a vacuum formed between the outer wall 211 and the inner wall 212. In some embodiments, the insulating medium 213 may comprise an insulating foam or other material having a low thermal conductivity (e.g., Styrofoam).

As shown in FIG. 2, in some embodiments the venting cap assembly 120 may comprise a quick release hose connector 230, a vessel connector 220, a straw coupler 216, and/or a straw 215. As discussed herein, the venting cap assembly 120, in combination with the fluid delivery tube 112 and mouthpiece 110, define a vertical-feed hydration system that may be used with a hydration vessel (e.g., such as hydration vessel 130) that delivers fluid from a reservoir 218 to the mouthpiece 110 for consumption by the user, and that also permits the fluid remaining in the fluid delivery tube 112 to drain back into the hydration vessel 130 between uses, instead of remaining stagnant in the fluid delivery tube 112. The vessel connector 220 may, among other things, provide an interface for securely fastening the venting cap assembly 120 to the hydration vessel 130, and supporting the straw 215 within the reservoir 218. That is, the vessel connector may at least in part function to fasten the venting cap assembly 120 to the hydration vessel 130.

As shown in FIG. 2, a proximal end of the straw 215 may connect to the vessel connector 220 via the straw coupler 216 at a position near the top 201 of the reservoir 218 while the distal end of the straw 215 is supported in a position suspended above the bottom 202 of the reservoir 218. As such, when fluid is drawn from the reservoir 218, the fluid is vertically fed (e.g., pulled or lifted) from the bottom 202 of the reservoir. As discussed in greater detail below, the vessel connector 220 further includes an equalization valve that permits air from the surrounding environment to flow into the reservoir 218 while fluid is drawn out from the reservoir 218 through the straw 215, thus avoiding a buildup of backpressure within the reservoir 218 while fluid is being drawn out. In various embodiments, the straw 215 may be fabricated from materials such as a stainless steel alloy material (e.g., an 18/8, 18/10, 304, or 316, grade stainless steel), and/or fabricated using other alloys or materials such as a titanium alloy, ceramic materials, or other composite materials.

The venting cap assembly 120 may further comprise a hose connector 230 (e.g., a quick release hose connector or other removable hose connector) that is coupled to an opposing end of the fluid delivery tube 112 from the mouthpiece 110. The quick release hose connector 230 may couple to the vessel connector 220 via a quick release fastening mechanism (or other fastening mechanism) to facilitate easy disconnection and/or reconnection of the fluid delivery tube 112 and mouthpiece 110 from the hydration vessel 130. In some embodiments, as discussed with respect to FIG. 3, the vessel connector 220 comprises a spring activated valve that seals the reservoir 218 when the quick release hose connector 230 is decoupled from the vessel connector 220 to prevent spillage and/or contamination of fluid within the reservoir 218. Although the venting cap assembly 120 is primarily described herein as used in conjunction with the hydration vessel 130, such examples are for illustration purposes only and not intended as limiting. Other embodiments may include a venting cap assembly 120 that may be used in combination with other vessels to produce a vertical-feed based hydration system.

Figure 3:
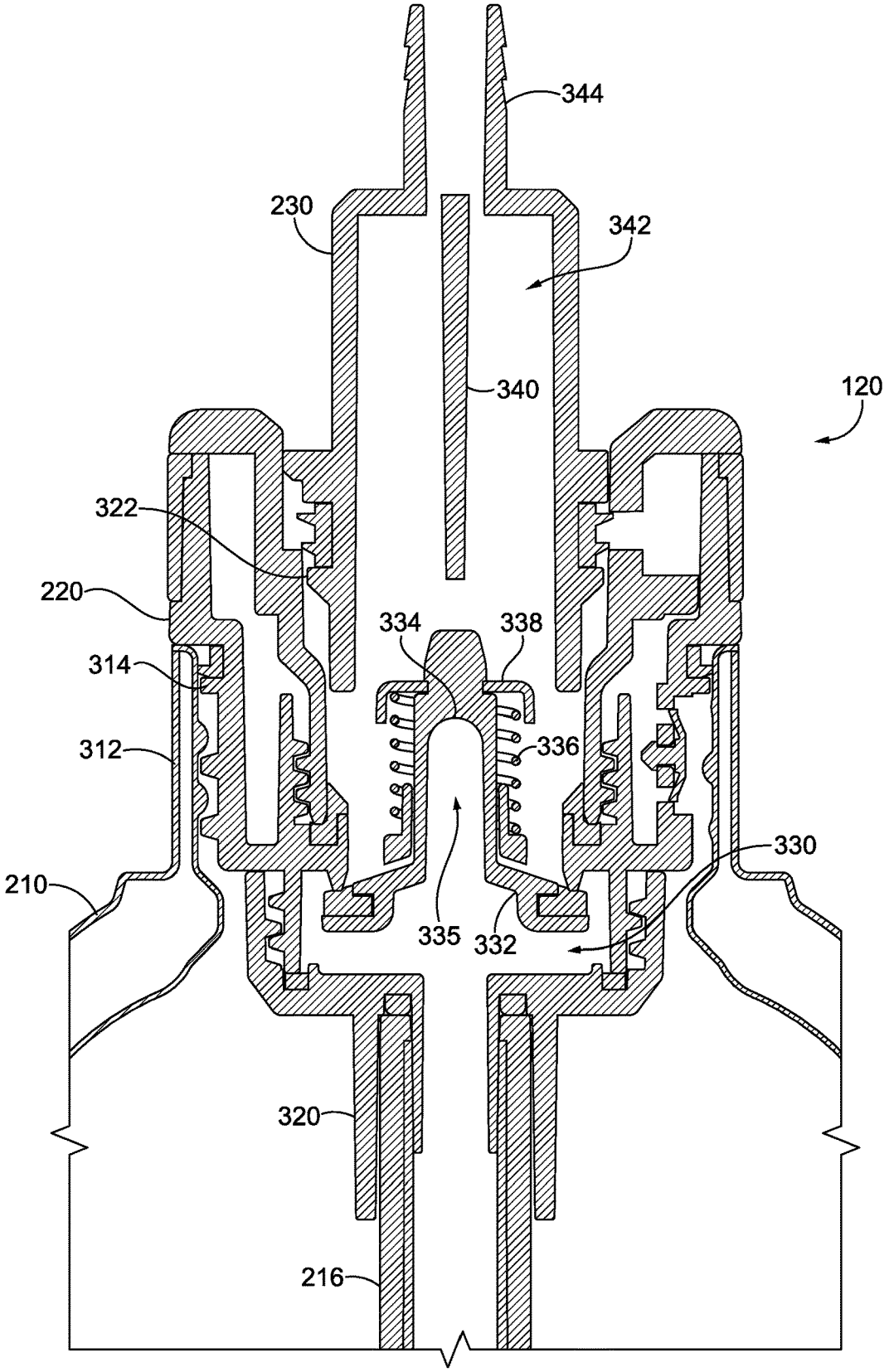
FIG. 3 is a cross sectional illustration further detailing features of an example venting cap assembly, in accordance with an embodiment of the present disclosure.

Referring now to FIG. 3, FIG. 3 is a cross sectional drawing further illustrating features of the venting cap assembly 120. As shown in FIG. 3, in some embodiments the vessel connector 220 may comprise a fastening mechanism, such as threads 314 that engage with corresponding threads 312 at the opening of the hydration vessel 130, in order to secure the venting cap assembly 120 to the hydration vessel 130. In other embodiments, other types of fasteners may be used to connect the vessel connector 220 to the hydration vessel 130. As described herein, the venting cap assembly 120 comprises an interior pathway defining an internal flow path between the straw 215 and the fluid delivery tube 112.

Within the reservoir 218, the vessel connector 220 may comprise a port 320 configured to interface with the straw coupler 216 to couple the straw 215 to the venting cap assembly 120. That is, the straw 215 may comprise a removable straw where the straw 215 may be attached and/or detached from the port 320 using the straw coupler 216. For example, the port 320 may comprise at least part of a keyed fastening mechanism, while the straw coupler 216 may comprise a corresponding part of the keyed fastening mechanism where one or more pins or other protrusions that engage with the keyed fastener (such as a keyed twist-to-lock fastening mechanism) to fasten the straw coupler 216 and the straw 215 to the vessel connector 220. Alternatively, in some embodiments, the port 320 may comprise threads that engage with threads of the straw coupler 216 to form a threaded connection. In other embodiments, other types of fasteners may be used to connect the straw coupler 216 and/or straw 215 to the venting cap assembly 120.

The quick release hose connector 230 may comprise a hose connector port 344 (e.g., a barbed connector port) to couple to the fluid delivery tube 112. In some embodiments, the quick release hose connector 230 and vessel connector 220 may comprise corresponding member of a fastener 322 that facilitates coupling and securing the quick release hose connector 230 to the vessel connector 220. The fastener 322 may include a quick release fastening mechanism, such as a twist-to-lock fastening mechanism 512 where the quick release hose connector 230 comprise one or more pins that engage with the vessel connector 220 in a twist-to-lock fashion to fasten the quick release hose connector 230 to the vessel connector 220. Alternatively, in some embodiments, the quick release hose connector 230 may comprise threads that engage with threads of the vessel connector 220 to form a threaded fastening mechanism. In other embodiments, other types of fasteners may be used to connect the quick release hose connector 230 to the vessel connector 220.

As further illustrated in FIG. 3, the vessel connector 220 may comprise a reservoir sealing valve 332 that operates to open and close in response to connecting and disconnecting the quick release hose connector 230. In some embodiments, the reservoir sealing valve 332 may comprise a spring-loaded poppet valve. The vessel connector 220 may comprise a coil spring 336 positioned around a stem 335 of the reservoir sealing valve 332 that is pre-loaded to apply a force against a stop member 338 coupled to the stem 335. With the quick release hose connector 230 disconnected from the vessel connector 220, the force of the coil spring 336 applied to the stop member 338 pulls the reservoir sealing valve 332 into a closed position within a first fluid pathway chamber 330 of the vessel connector 220, where the fluid pathway chamber 330 has an open flow path to the reservoir 218 via the straw 215. With the reservoir sealing valve 332 in this closed position, the reservoir 218 is effectively sealed to prevent spillage and/or contamination of fluid within the reservoir 218. In order to open the reservoir sealing valve 332 in response to an attachment of the quick release hose connector 230, the quick release hose connector 230 may comprise a valve actuator 340 that functions to apply a force to depress the stem 335 of the reservoir sealing valve 332 and compress the coil spring 336 as the quick release hose connector 230 is attached to the vessel connector 220. As the stem 335 of the reservoir sealing valve 332 is depressed by the valve actuator 340, the reservoir sealing valve 332 is pushed into an open position within the first fluid pathway chamber 330—thus opening a flow path between the first fluid pathway chamber 330 and a second fluid pathway chamber 342 defined within the interior of the quick release hose connector 230. The second fluid pathway chamber 342, in turn, is coupled to the hose connector port 344. As such, in some embodiments, the attachment of the quick release hose connector 230 to the vessel connector 220 opens the reservoir sealing valve 332 creating a continuous flow path for fluid flow between the straw 215 (and/or the reservoir 218) and the mouthpiece 110.

Figure 4:
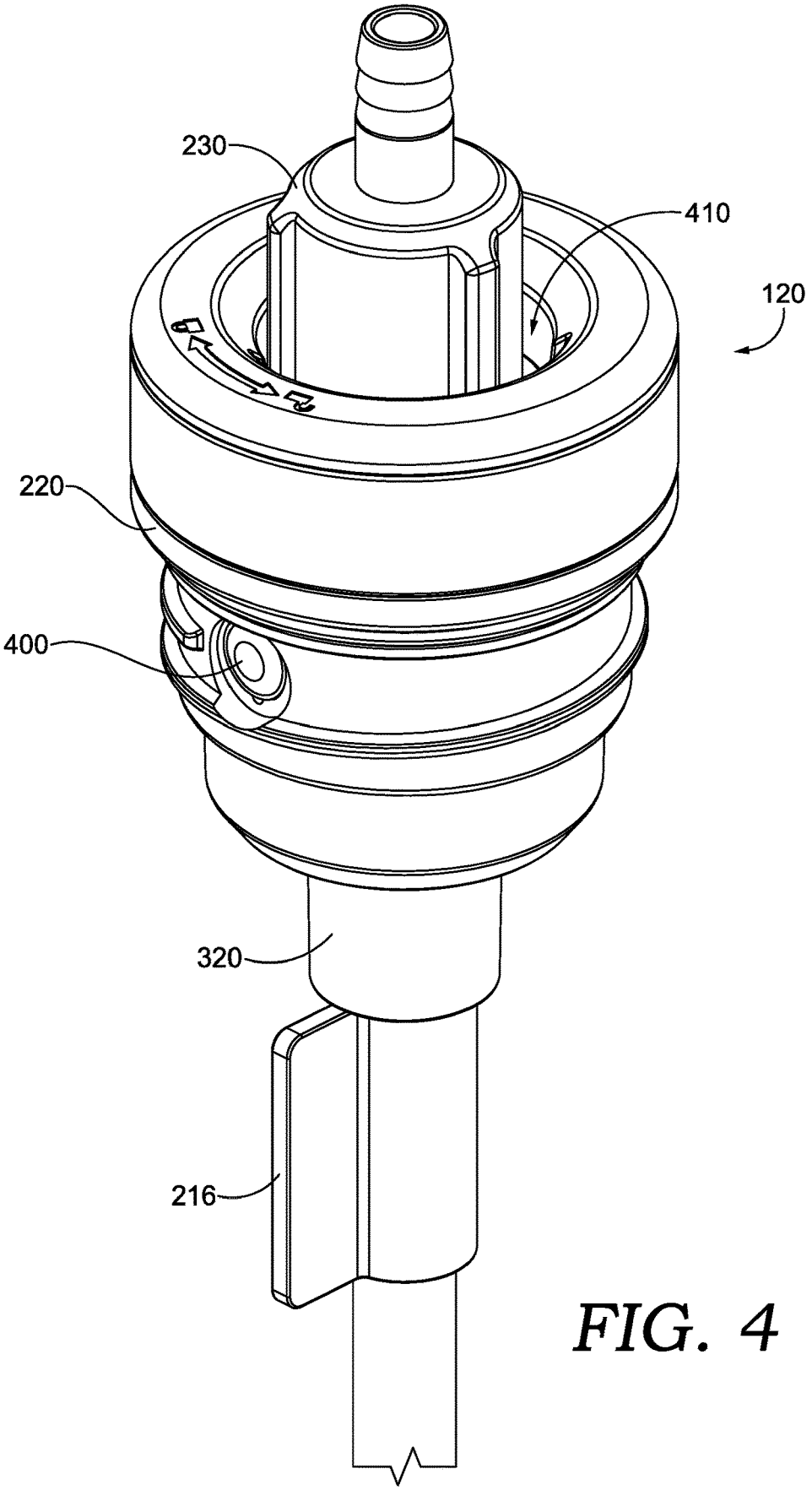
FIG. 4 is a drawing illustrating an alternate view of an example venting cap assembly, in accordance with an embodiment of the present disclosure.

Referring now to FIG. 4, FIG. 4 illustrates an alternate view of the venting cap assembly 120 discussed with respect to FIG. 3, with the quick release hose connector 230 fastened to the vessel connector 220, and the port 320 of vessel connector 220 coupled to a straw coupler 216 (where straw 215 is not illustrated in order to simplify the drawing). In particular, FIG. 4 depicts the equalization valve 400 of the venting cap assembly 120 discussed herein. In some embodiments, the equalization valve 400 may operate as a one-way valve (or check-valve) that permits air to flow into the reservoir 218 in response to fluid being drawn out from reservoir 218 through the straw 215, but does not permit fluid from the reservoir 218 to leak out of the reservoir 218 from the equalization valve 400. In some embodiments, the equalization valve 400 is at least in part located on an exterior wall of the vessel connector 220 that is exposed to the reservoir 218 when the vessel connector 220 is installed into hydration vessel 130. In some embodiments, the equalization valve 400 may draw in air for equalizing the reservoir 218 from a cavity 410 of the vessel connector 220 that is exposed to the external environment.

Figure 5:
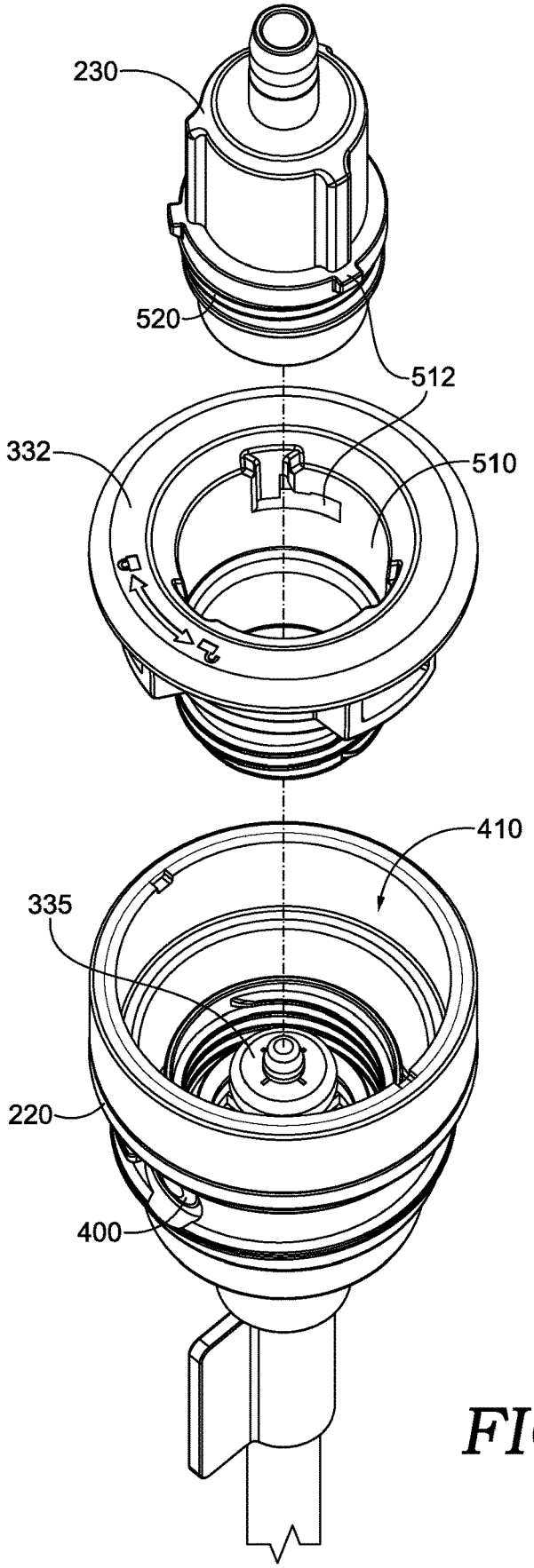
FIG. 5 is a drawing illustrating a partially exploded view of an example venting cap assembly, in accordance with an embodiment of the present disclosure.

Referring now to FIG. 5, FIG. 5 illustrates an alternate partially exploded view of the venting cap assembly 120 discussed with respect to FIG. 2, with the quick release hose connector 230 and fastening mechanism 322 detached from the vessel connector 220. The vessel connector 220 may comprise a cavity 410 for receiving the fastening mechanism 322 and quick release hose connector 230, and insertion of the quick release hose connector 230 depresses the stem 335 of reservoir sealing valve 332 downward to open the reservoir sealing valve 332. In some embodiments, the quick release hose connector 230 may comprises one or more sealing gaskets 520 that seal against an interior wall 510 of the vessel connector 220 to create a water-tight seal when the quick release hose connector 230 is connected to the vessel connector 220.

Figure 6:
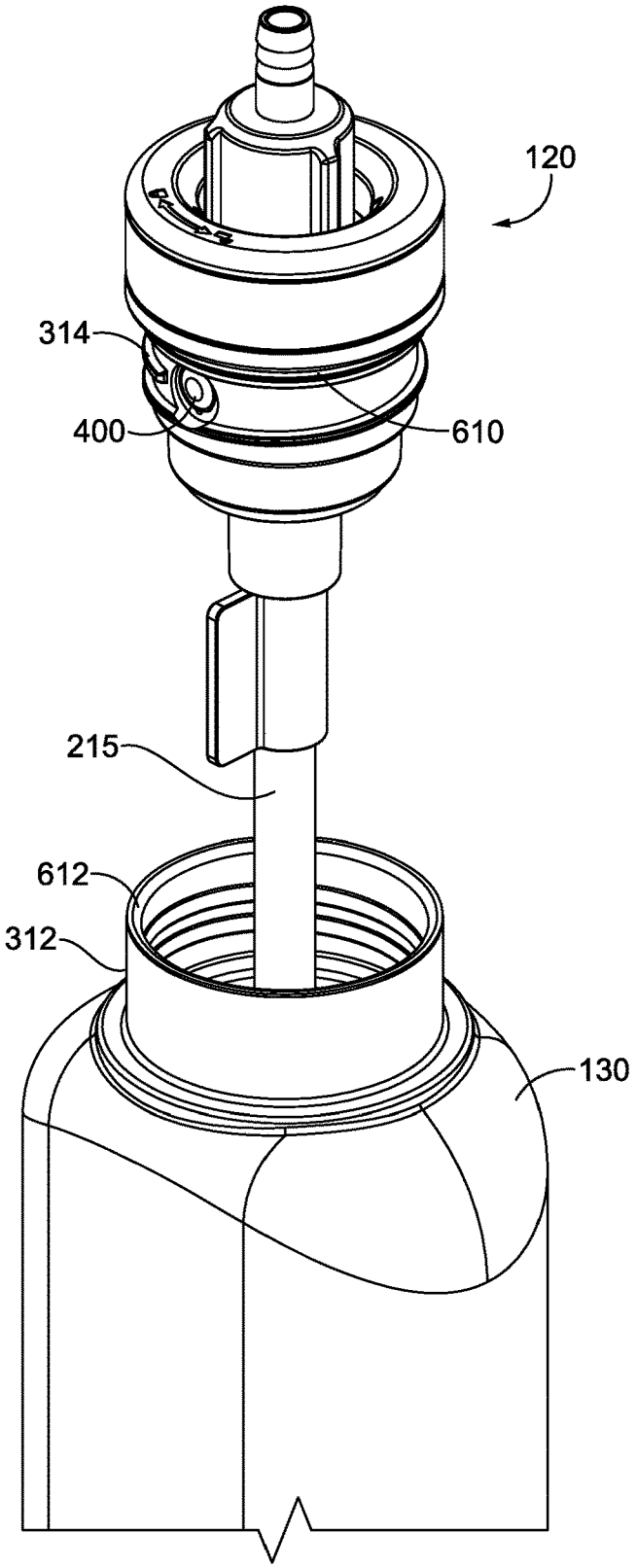
FIG. 6 is a diagram illustrating an example of a venting cap assembly in combination with a hydration vessel, in accordance with an embodiment of the present disclosure.

FIG. 6 illustrates the insertion of the venting cap assembly 120 to the hydration vessel 130 in order to fasten those elements together. The straw 215 may be inserted into the opening of the hydration vessel 130 (e.g., into reservoir 218) and the venting cap assembly 120 secured by engaging the threads 314 of the venting cap assembly 120 with the threads 312 about the opening of the hydration vessel 130. In some embodiments, the venting cap assembly 120 may comprise one or more gaskets 610 that seal against a flange 612 of the hydration vessel 130 to form a water-tight seal between the venting cap assembly 120 and the hydration vessel 130. As illustrated by FIG. 6, when the venting cap assembly 120 is installed, the equalization valve 400 may be positioned in alignment with the threads 312 and 314 such that the threads provide an air passage for equalizing air to flow from the equalization valve 400 into the reservoir 218.

Figure 7A:
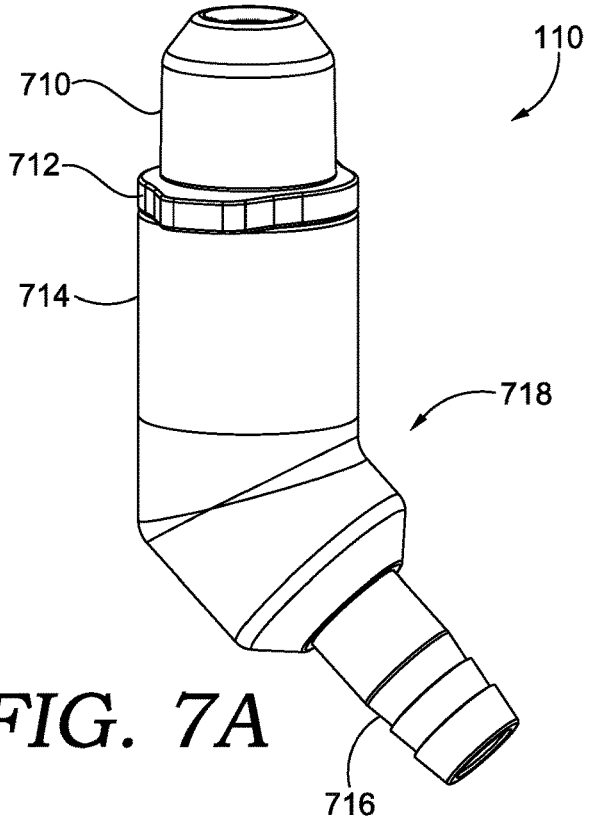
FIGS. 7A and 7B are diagrams illustrating an example of a mouthpiece comprising a flow control valve, in accordance with an embodiment of the present disclosure.
Figure 7B:
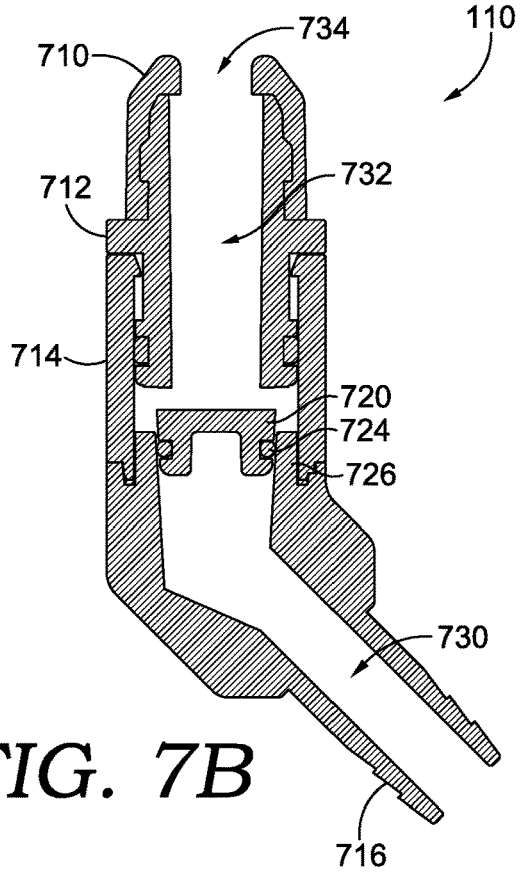

FIGS. 7A and 7B are diagrams illustrating and example mouthpiece 110 in accordance with embodiments of the present disclosure. In this example embodiment, the mouthpiece 110 comprises a push-pull type of position-latching valve. However, embodiments may include other types of mouthpieces other than shown in FIGS. 7A and 7B. Other flow control valves type that may be used for mouthpiece 110 may include, but are not limited to, a dial-controlled valve, a lever-controlled valve, a button-activated valve, other position-latching valve types, other valves that facilitate clearing of fluid from the fluid delivery tube 112 back into the hydration vessel 130. In some embodiments, mouthpiece 110 may at least in part comprise a bite valve.

As shown in FIG. 7A, the mouthpiece 110 may include a body 714 that comprises a hose connector 716 (e.g., a barbed connector port) that may be used to couple the mouthpiece 110 to the fluid delivery tube 112. In some embodiments, the body 714 may include a bend or angle (as shown at 718) to help orient a drinking port 734 of the mouthpiece 110 towards the mouth of the user. The drinking port 734 may include a port cover 710 that comprises, for example, a plastic, soft silicone, or similar material that is coupled to a valve actuator 712 of the mouthpiece 110. As described herein, the mouthpiece 110 comprises an interior pathway defining a flow path between the fluid delivery tube 112 and a drinking port 734 of the mouthpiece 110.

Referring to FIG. 7B, the valve actuator 712 may extend into the body 714 of the mouthpiece 110, and comprise a stopper member 720 that seals against an internal wall 726 of the mouthpiece 110 to define a push-pull valve. In some embodiments the stopper member 720 may include a gasket 724 (e.g., an o-ring) to create a water-tight seal between the stopper member 720 and the internal wall 726 when the push-pull valve is in the closed position. When the stopper member 720 is disengaged from the internal wall 726 (e.g., the push-pull valve is open), an internal channel 730 within the body 714 may freely communicate with an internal channel 732 within valve actuator 712 to complete a flow path (e.g., for air and/or fluids) between the drinking port 734 and the hose connector 716. When the stopper member 720 is engaged with the internal wall 726 (e.g., the push-pull valve is open), the internal channel 730 within the body is isolated from the internal channel 732 within valve actuator 712 to close the flow path between the drinking port 734 and the hose connector 716. Operating as a position-latching valve, a closed flow path within the mouthpiece 110 remains closed until the valve actuator 712 is pulled out from the body 714 to open it, and an open flow path within the mouthpiece 110 remains open until the valve actuator 712 is pushed into the body 714 to close it.

Figure 8:
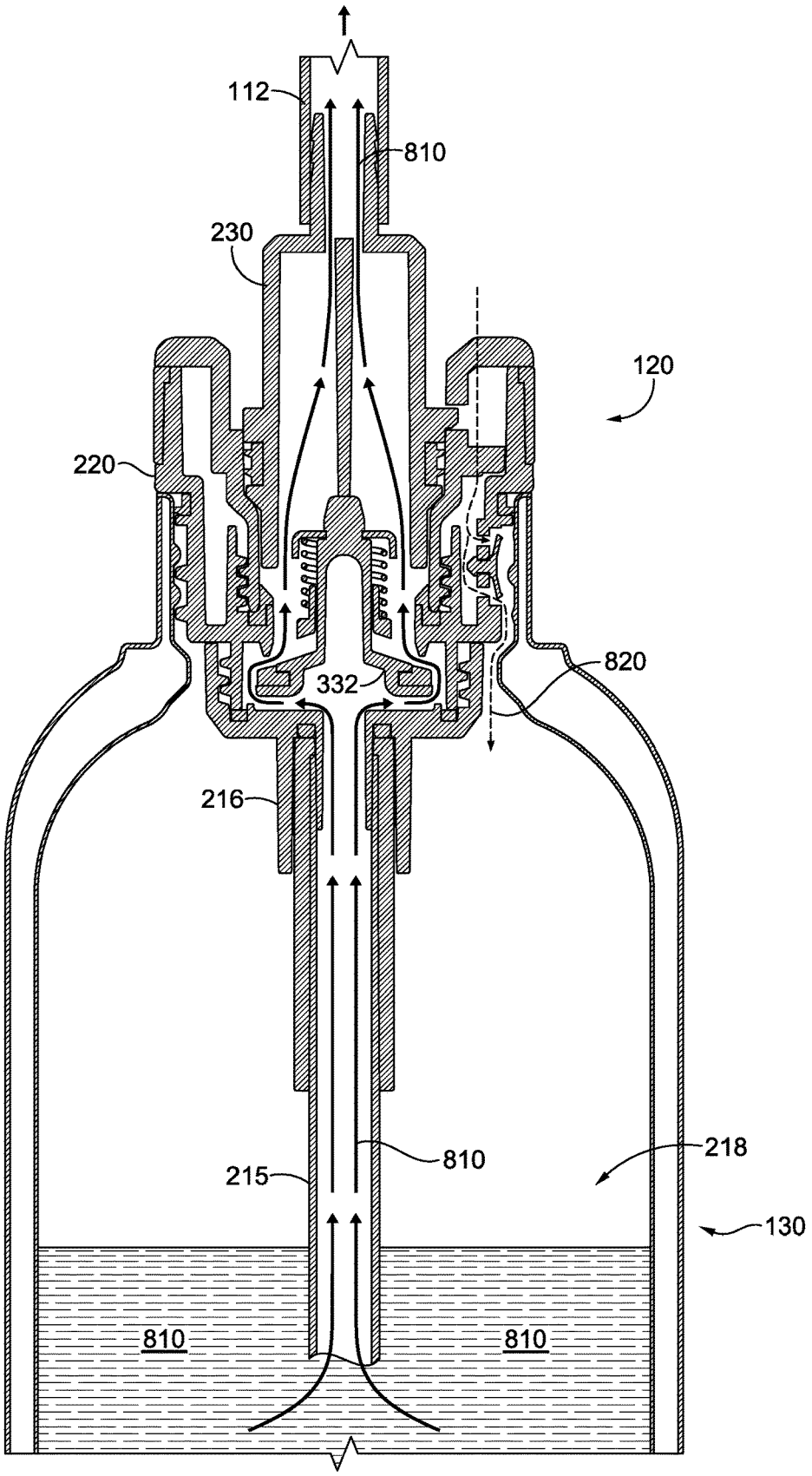
FIG. 8 is a cross-section drawing of the hydration vessel with a vertical-feed based venting cap assembly operating as a vertical-feed system, in accordance with an embodiment of the present disclosure.

Referring now to FIG. 8, FIG. 8 is a cross-section drawing of the hydration vessel 130 with a vertical-feed based venting cap assembly 120 operating as a vertical-feed system that may provide hydrating fluid to a user of a personal hydration system 100. As shown in FIG. 8, the quick release hose connector 230 is connected to the vessel connector 220, thus opening reservoir sealing valve 332 to permit fluid flow out from the reservoir 218 and into fluid delivery tube 112 in response to a vacuum drawn from the mouthpiece 110 (e.g., from a user using their mouth to draw the fluid through an open mouthpiece 110). An application of the negative pressure of a vacuum applied to the mouthpiece 110 overcomes the force of gravity on fluid 810 in the reservoir 218, and feeds that fluid 810 from the reservoir 218 vertically up through the straw 215, through the internal pathways within the venting cap assembly 120, until the fluid reaches the mouthpiece 110, from which the fluid 810 is dispensed to the user. The pull of fluid 810 into straw 215 causes a negative pressure within reservoir 218, and a corresponding pressure differential across equalization valve 400 that opens equalization valve 400 to permit and equalizing airflow 820 to flow into reservoir 218 which limits the buildup of negative pressure within reservoir 218. Limiting this backpressure increases the effectiveness of personal hydration system 100, and improves user experience. That is, the user does not need to exert increasingly greater levels of effort to apply suction to extract fluid from the mouthpiece 110 as they are drinking from the reservoir 218 (as would be the case if without equalizing airflow 820) increasing their ability to consistently judge the suction they need to apply to extract a given unit of fluid from the reservoir 218. When the user has completed taking a drink from the hydration system 100, they can cease applying suction to the mouthpiece 110 and leave the mouthpiece 110 open until fluid remaining in the fluid delivery tube 112 drains back into the reservoir 218 of the insulated hydration vessel 130. As such, the non-dispensed fluid does not remain in the fluid delivery tube 112, where it may be subject to undesired heating and/or freezing due to environmental conditions, and/or absorbing undesired tastes from remaining in the fluid delivery tube 112. In some embodiments, the fluid may be drawn back into the reservoir 218 based on the force of gravity and/or a differential in pressure between atmospheric pressure at the open mouthpiece 110 and the air within the reservoir 218. Once the fluid has drained from the fluid delivery tube 112, the user may close the valve of the mouthpiece 110.

Various modifications and different embodiments are described herein in detail with reference to the accompanying drawings so that those skilled in the art can carry out the disclosure. It should be understood, however, that the present disclosure is not intended to be limited to the specific embodiments, but the present disclosure includes modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof. This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar or equivalent to those described in this disclosure, and in conjunction with other present or future technologies. The examples herein are intended in all respects to be illustrative rather than restrictive. In this sense, alternative examples or implementations can become apparent to those of ordinary skill in the art to which the present subject matter pertains without departing from the scope hereof.

What is claimed is:

1. A vertical-feed hydration system, the system comprising:

a venting cap assembly configured to couple to a hydration vessel comprising an interior volume that defines a reservoir;

a removable straw coupled to the venting cap assembly, wherein the removable straw is configured to extend into the reservoir;

a fluid delivery tube having a first end coupled to the venting cap assembly, wherein the venting cap assembly comprises a first interior pathway defining a first flow path between the removable straw and the fluid delivery tube; and a mouthpiece comprising a position-latching flow control valve, the mouthpiece coupled to a second end of the fluid delivery tube, wherein the mouthpiece comprises a second interior pathway defining a second flow path between the fluid delivery tube and a drinking port of the mouthpiece; and wherein the venting cap assembly comprises an equalization valve configured to open in response to a suction applied to the mouthpiece, to pass an equalizing air into the reservoir from an environment external to the hydration vessel;

wherein the position-latching flow control valve is configured to remain in an open state after cessation of the suction applied to the mouthpiece until a subsequent actuation force is applied to close the position-latching flow control valve; and wherein the system is configured such that fluid remaining in the fluid delivery tube drains back into the reservoir through the removable straw when the suction applied to the mouthpiece ceases and the position-latching flow control valve remains in the open state.

2. The system of claim 1, wherein the position-latching flow control valve comprises a push-pull valve, a dial-controlled valve, a lever-controlled valve, or a button-activated valve.

3. The system of claim 1, wherein the venting cap assembly further comprises:

a vessel connector configured to fasten the venting cap assembly to the hydration vessel; and a hose connector coupled to the vessel connector by a quick-release fastening mechanism, wherein the fluid delivery tube is coupled to the hose connector.

4. The system of claim 3, wherein the vessel connector comprises a reservoir sealing valve configured to operate from an open position to a closed position in response to a disconnection of the hose connector from the vessel connector.

5. The system of claim 1, wherein the system further comprises the hydration vessel, the hydration vessel comprising an insulated hydration vessel that thermally insulates the reservoir based on a double-walled housing that includes an outer wall, an inner wall, and an insulating medium between the outer wall and the inner wall.

6. The system of claim 1, wherein the equalization valve is configured to permit air flow into the reservoir only in response to negative pressure within the reservoir created by the suction applied to the mouthpiece.

7. The system of claim 1, wherein the system operates without pressurization of the reservoir and relies solely on user-applied suction at the mouthpiece to draw fluid vertically from the reservoir through the removable straw.

8. The system of claim 1, wherein the hydration vessel comprises at least one of: a stainless steel alloy material, a titanium alloy, a ceramic material, and a composite material.

9. The system of claim 1, wherein the removable straw is detachable from the venting cap assembly to facilitate cleaning and maintenance of the system.

10. The system of claim 1, wherein the system is configured to prevent fluid from remaining stagnant in the fluid delivery tube between uses by enabling complete drainage back into the reservoir.

11. The system of claim 1, wherein the drainage of fluid from the fluid delivery tube back into the reservoir occurs based on at least one of gravity and a pressure differential between atmospheric pressure at the mouthpiece and air within the reservoir.

12. The system of claim 1, wherein the venting cap assembly includes a quick release hose connector that enables rapid separation and re-attachment of the fluid delivery tube from the hydration vessel.

13. The system of claim 1, wherein the equalization valve prevents buildup of negative pressure inside the hydration vessel during fluid extraction, maintaining consistent effort required by a user to draw fluid from the reservoir.

14. A vertical-feed hydration system, the system comprising:

an insulated hydration vessel comprising an interior volume that defines a reservoir;

a venting cap assembly configured to couple to the insulated hydration vessel;

a straw coupled to the venting cap assembly, wherein the straw is configured to extend from the venting cap assembly into the reservoir;

a fluid delivery tube having a first end coupled to the venting cap assembly, wherein the venting cap assembly comprises a first interior pathway defining a first flow path between the straw and the fluid delivery tube; and a mouthpiece comprising a position-latching flow control valve and a drinking port, wherein the mouthpiece is coupled to a second end of the fluid delivery tube, wherein the venting cap assembly comprises a second interior pathway defining a second flow path between the fluid delivery tube and the drinking port;

wherein the system is configured to draw a fluid vertically from the reservoir through the straw and the fluid delivery tube to the mouthpiece in response to a suction applied to the mouthpiece without pressurization of the reservoir; and wherein the system is configured to drain the fluid from the fluid delivery tube back into the reservoir through the straw in response to removal of the suction applied to the mouthpiece while the position-latching flow control valve remains in an open state until a subsequent actuation force is applied to close the position-latching flow control valve.

15. The system of claim 14, wherein the venting cap assembly comprises an equalization valve configured to open in response to the suction applied to the mouthpiece, to pass an equalizing air into the reservoir from an environment external to the insulated hydration vessel.

16. The system of claim 14, wherein the position-latching flow control valve comprises a push-pull valve, a dial-controlled valve, a lever-controlled valve, or a button-activated valve.

17. The system of claim 14, wherein the insulated hydration vessel is configured to thermally insulate the reservoir to prevent undesired heating or freezing of fluid within the reservoir due to environmental conditions.

18. The system of claim 14, wherein the straw is removably coupled to the venting cap assembly and extends to a position suspended above a bottom of the reservoir to enable drawing of substantially all fluid from the reservoir.

19. The system of claim 14, wherein the system prevents absorption of undesired tastes into fluid by eliminating stagnant fluid remaining in the fluid delivery tube between uses.

20. The system of claim 14, wherein the position-latching flow control valve enables the user to cease applying suction while leaving the mouthpiece open until fluid remaining in the fluid delivery tube completely drains back into the reservoir, after which the user may close the valve.

* * * * *